United States Patent [19]

Stolkin et al.

[11] 4,007,869

[45] Feb. 15, 1977

[54] CORRUGATED CARTON CONSTRUCTIONS

[75] Inventors: Walter J. Stolkin, Chicago; Alan M. Sax, Arlington Heights, both of Ill.

[73] Assignee: Stolmar Corporation, Chicago, Ill.

[22] Filed: Jan. 14, 1976

[21] Appl. No.: 648,886

[52] U.S. Cl. ..... 229/41 B; 229/39 R

[51] Int. Cl.[2] ..... B65D 5/08; B65D 5/10

[58] Field of Search ..... 229/39 R, 41 B

[56] References Cited

UNITED STATES PATENTS

| | | | |
|---|---|---|---|
| 2,513,079 | 6/1950 | Buerger | 229/41 B |
| 2,702,154 | 2/1955 | Linson | 229/41 B X |
| 2,781,160 | 2/1957 | Bolding | 229/41 B |
| 2,861,734 | 11/1958 | Garmam | 229/41 B |
| 2,898,029 | 8/1959 | Sherman | 229/41 B |
| 3,517,875 | 5/1970 | Wakefield | 229/41 B X |
| 3,690,543 | 9/1972 | Zeitter | 229/39 R |
| 3,927,824 | 12/1975 | Razziano | 229/41 B X |

*Primary Examiner*—Davis T. Moorhead

*Attorney, Agent, or Firm*—McDougall, Hersh & Scott

[57] ABSTRACT

Carton constructions for manufacture from corrugated sheets are disclosed. The constructions relate to the type wherein an automatic bottom is employed. When the carton is opened from its collapsed condition the bottom, which is interconnected, automatically deploys in a locked position. By use of particular dimensional arrangements for the bottom flaps, the usual tendency of such automatic bottom cartons to collapse once opened is eliminated as well as the problem of bridging in overlap configurations.

10 Claims, 10 Drawing Figures

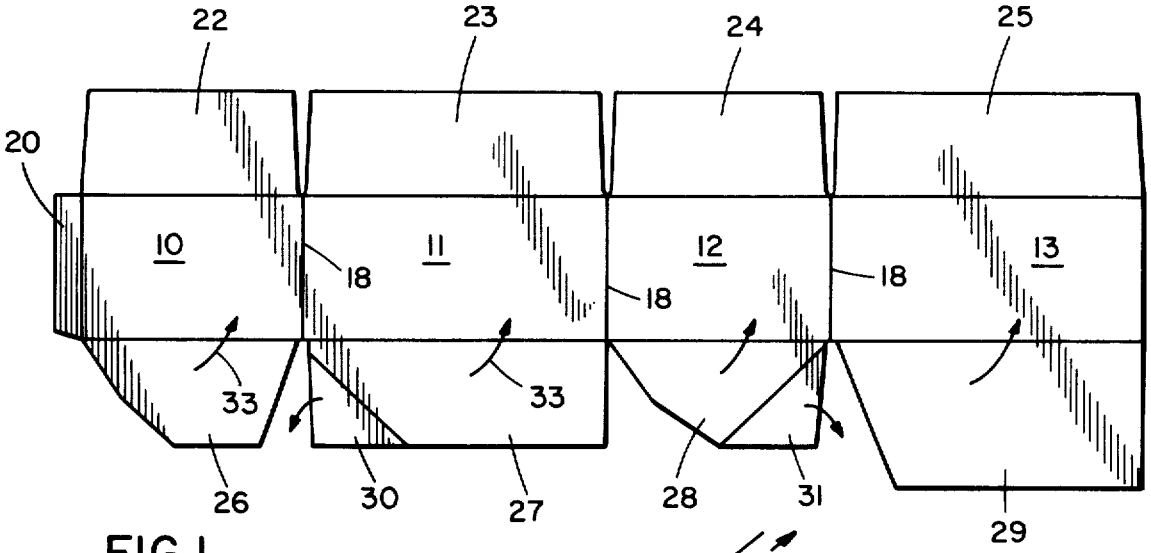
FIG.1
PRIOR ART
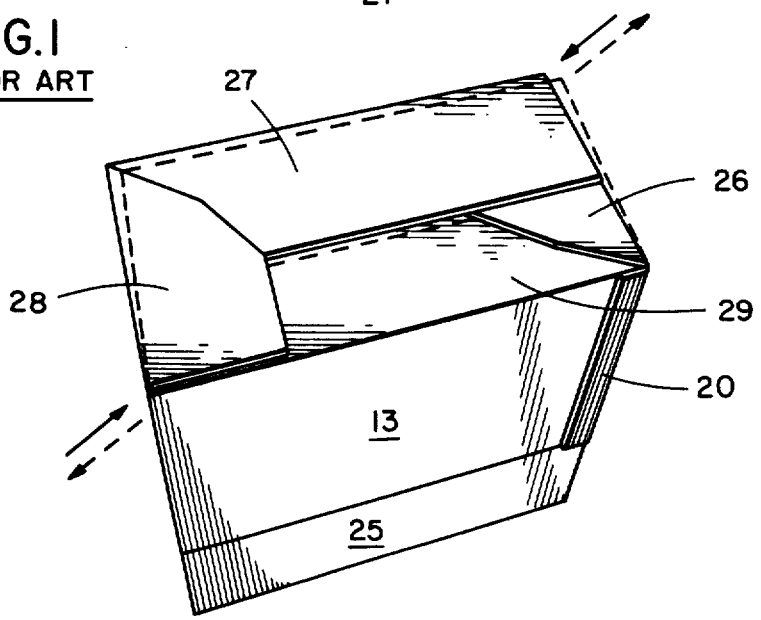
FIG.2
PRIOR ART
FIG.3
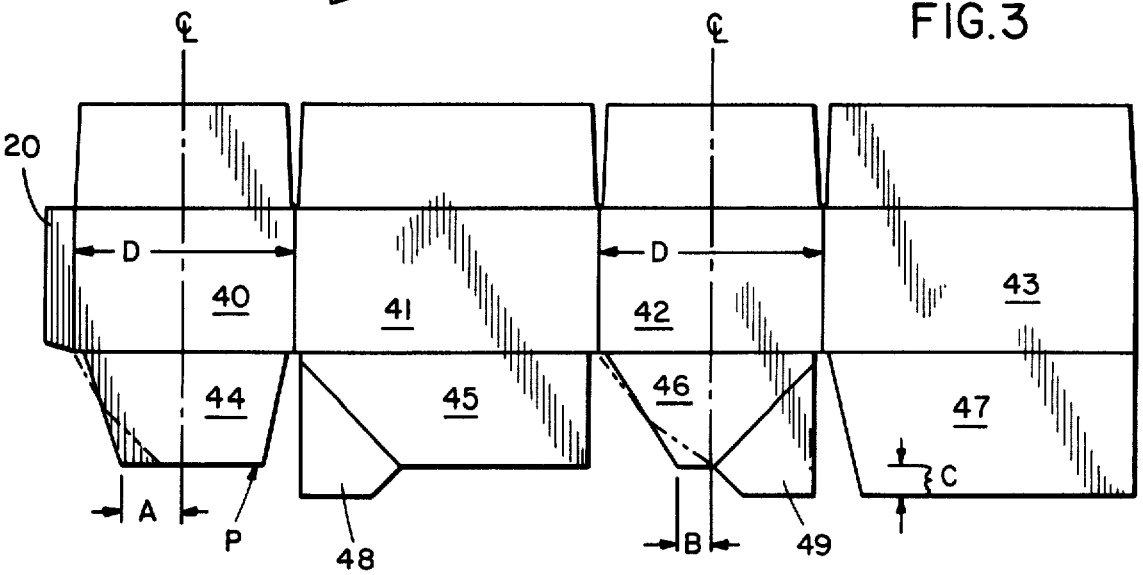

CORRUGATED CARTON CONSTRUCTIONS

BACKGROUND OF THE INVENTION

This invention relates to the field of carton constructions. More specifically, it relates to the field of carton constructions for manufacture from corrugated paper and in particular to corrugated carton constructions which employ an automatic bottom feature. By automatic bottom it is meant that when the carton is opened to its normal position for loading, the bottom is automatically deployed in position without the need for manually securing it. Such constructions in chipboard have long been known. Examplary of a large number of such prior art constructions are U.S. Pat. Nos. 2,781,160, 3,517,875, and 3,690,543. However, in corrugated constructions, particularly with large size containers, automatic bottom carton constructions have only recently come into use. An example of an automatic bottom carton construction is disclosed in pending U.S. Pat. application Ser. No. 523,996, now U.S. Pat. No. 3,960,313 assigned to the present assignee.

In the referenced patent application a corrugated carton construction is disclosed having an automatic bottom. That construction has a tendency, upon opening, to favor returning to the collapsed position until weight is placed on the bottom as occurs during the process of loading the carton.

A further problem occurs when it is desired to produce an overlapped bottom. That is, a bottom in which the panels overlap one another by a selected amount. This provides for increased strength and other desirable features. When an overlapped construction is utilized in corrugated automatic bottoms there is a tendency during opening for bridging to occur. Bridging is the phenomenon of two opposed sides, usually the longer two sides of a carton, to strike each other as they move towards the open position. Bridging prevents the cartons from fully deploying and requires that the carton be manually opened when this occurs.

It is accordingly an object of the present invention to provide an improved automatic bottom carton construction for corrugated container blanks.

It is another object of the present invention to provide a corrugated container blank with an automatic bottom feature which will not tend to collapse upon opening.

It is a further object of the invention to provide an automatic bottom corrugated carton blank which has an overlap and further including provisions for avoiding bridging of the bottom flap during opening of the carton.

Another object of the invention is to provide a corrugated carton construction employing pressure flaps on two of the bottom flaps whereby once a carton is opened to a point beyond the engagement of the pressure flaps with the adjacent flaps the carton is maintained in the opened position due to the presence of the pressure flaps preventing a return of the carton to its collapsed condition.

A further object of the invention is to provide a pressure and relief flap carton construction for a corrugated container wherein bridging is prevented due to the fact that opposite flap members are lowered to the deployed position in a specified order, one before the other.

Other objects and advantages of the invention will become apparent from the remaining portion of the specification.

BRIEF DESCRIPTION OF THE DRAWINGS

FIG. 1 is a corrugated container blank according to the prior art.

FIG. 2 is an illustration of a prior art carton construction in its opened position indicating the tendency of such construction to revert to its collapsed condition.

FIG. 3 is a carton construction according to a first embodiment of the present invention wherein a pressure and relief flap are employed.

DETAILED DESCRIPTION

Figure 4:
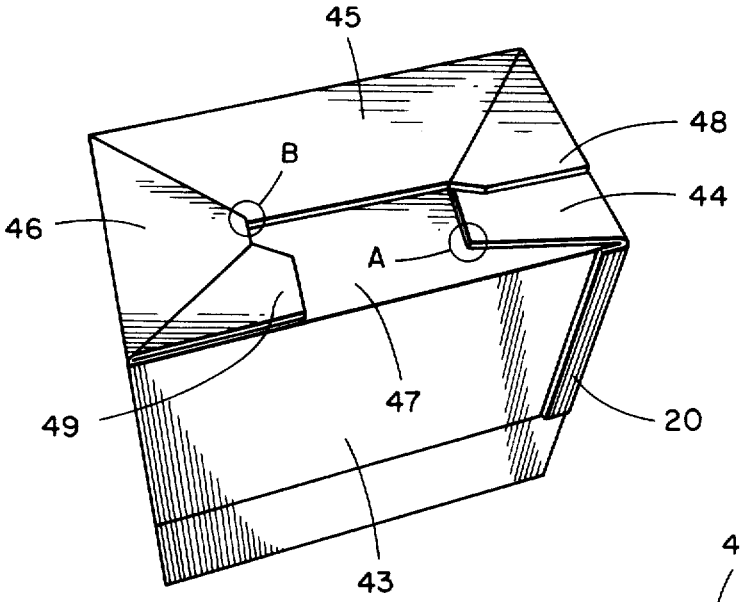
FIG. 4 is a bottom perspective of the blank of FIG. 3 in its assembled position.

Referring now to FIGS. 1 and 2, an automatic carton blank according to the prior art is disclosed. Such blank is formed from corrugated cardboard by precision cutting dyes in a manner well known in the art. The blank includes side panels 10, 11, 12 and 13, each panel defined by a scoreline 18. Extending outwardly from the panel 10 is the manufacturer's joint or glue flap 20 used to join panel 10 to panel 13 to form a completed carton. Attached to the side panels 10 through 13 are top panels 22 through 25. Depending downwardly from the side panels are bottom panels 26 through 29. In automatic bottom constructions the bottom panels include a glue flap portion, such as glue flap portions 30 and 31 on panels 27 and 28.

As is described in co-pending application Ser. No. 523,996, incorporated herein by reference, the automatic bottom construction is formed by folding the bottom panels over onto the side panels in the manner indicated generally by the arrows 33 in FIG. 1. The triangular glue flaps 30 and 31 are reversely folded as the bottom panels are folded over. Glue is then applied either to the glue panels 30 and 31 or to the corresponding portion of panels 26 and 29 so that when the blank is folded on score lines 18 to join the manufacturer's flap 20 to panel 13, the glue flaps 30 and 31 will engage and become adhesively secured to the bottom panels 26 and 29.

In this collapsed condition the carton is ideal for shipping in large quantities. When it is desired to use the carton, pressure is applied to the edges of the carton causing it to open into a rectangular shape. At the same time, the bottom panels move in a direction opposite the arrows 33 in FIG. 1 to form a secured bottom due to the interconnection of the panels 26–29 by the glue flaps 30 and 31. More specifically, the panels are interconnected in pairs, the panels 26 and 27 forming one interconnected pair and the panels 28 and 29 forming the other interconnected pair.

Referring to FIG. 2, the configuration of the automatic bottom upon opening the carton is illustrated an "over and under" relationship is achieved wherein one outer end of the pair 26, 27 extends over an outer end of the pair 28, 29 while the other outer end of the pair 26, 27 extends under the other outer end of the pair 28, 29. The assembled carton is then loaded and the top secured in the usual manner. A problem with the carton construction illustrated in FIG. 1, which construction is in all other respects highly satisfactory, is the tendency of the carton when first opened to tend to revert to its collapsed condition. This tendency is indicated in FIG. 2 by the dashed outline.

It is an important aspect of the present invention to provide a carton construction in which this tendency to collapse immediately after opening is eliminated while at the same time eliminating bridging. In FIG. 1 the bottom panel 29 is longer than the bottom panel 27 and, therefore, in the assembled condition panel 29 overlaps panel 27. This arrangement is often desirable to provide improved strength for certain packing specifications and applications. Where an overlap is used, however, the bridging problem is introduced. Bridging occurs when the end of panel 29 catches on the end of panel 27, thereby preventing full deployment of the carton.

Referring now to FIGS. 3 through 6, the carton construction according to a first embodiment of the invention is illustrated. The present invention addresses itself to the solution of the two aforementioned problems. In FIG. 3 there is disclosed a carton blank of a type similar to FIG. 1. It is noted that this blank is an overlapped blank as was the FIG. 1 blank. The FIG. 3 blank includes side panels 40 through 43 from which depend bottom panels 44 through 47, respectively. Glue flaps 48 and 49 are carried by the bottom panels 45 and 46. The principal objects of the invention, namely, the prevention of bridging on overlapped cartons and the prevention of collapsing all automatic bottom cartons is achieved by properly selecting the dimensions of a portion of the bottom panels 44 and 46.

For reasons which will become apparent, the dimension from the center line of bottom panel 44 to the left edge, denoted A, and the dimension from the center line of bottom panel 46 to the left edge, denoted B, have certain critical relationships with respect to the desired objectives. For comparison purposes, the bottom flap dimension of the prior art has been indicated in dashed lines on the bottom flaps 44 and 46 to indicate the differences in the dimensions A and B. Additionally, it will be noticed that the glue flaps 48 and 49 have slightly different dimensions than the FIG. 1 embodiment.

The portion of flap 44 indicated by dimension A will hereafter be referred to as a pressure flap, while the portion of panel 46 indicated by dimension B will hereafter be referred to as a relief flap. As used in this specification, the terms pressure and relief flap refer to the function of such a flap on an immediately adjacent panel, in this case, panels 45 and 47, respectively. In overlap carton constructions it has been found desirable to provide one pressure flap and one relief flap for the purpose to be described. In the second embodiment illustrated in FIGS. 7 through 10 it has been found desirable to provide two pressure flaps and no relief flap.

As previously stated, the carton construction illustrated in FIG. 3 is an overlapped construction as indicated by dimension C, the dimension by which the panel 47 exceeds the length of panel 45. The width of side panels 40 and 42 is indicated by dimension D.

The carton construction of FIG. 3 is assembled in a manner identical to that described for FIG. 1 and indicated in more detail in the incorporated co-pending patent application.

Figure 5:
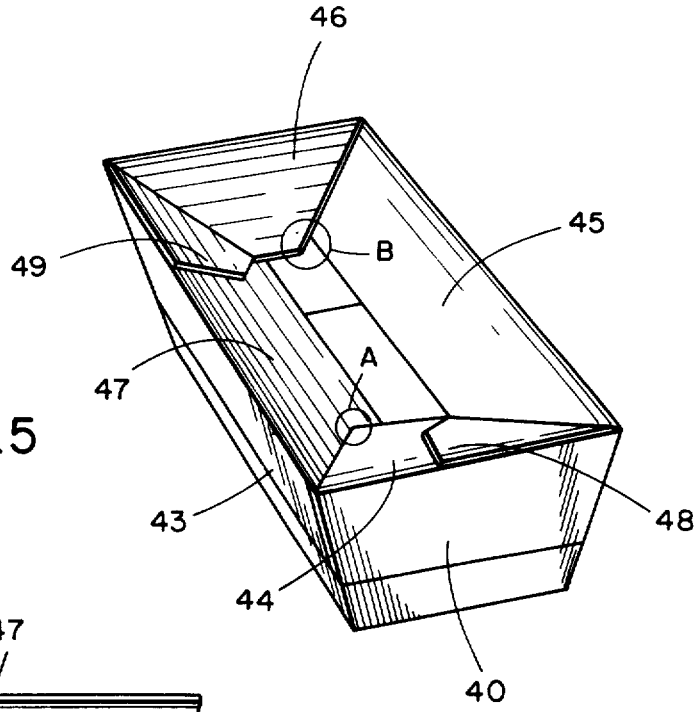
FIG. 5 is a view similar to FIG. 4 showing the blank in an intermediate position between its collapsed and opened position to illustrate the effect of the pressure and relief flaps.
Figure 6:
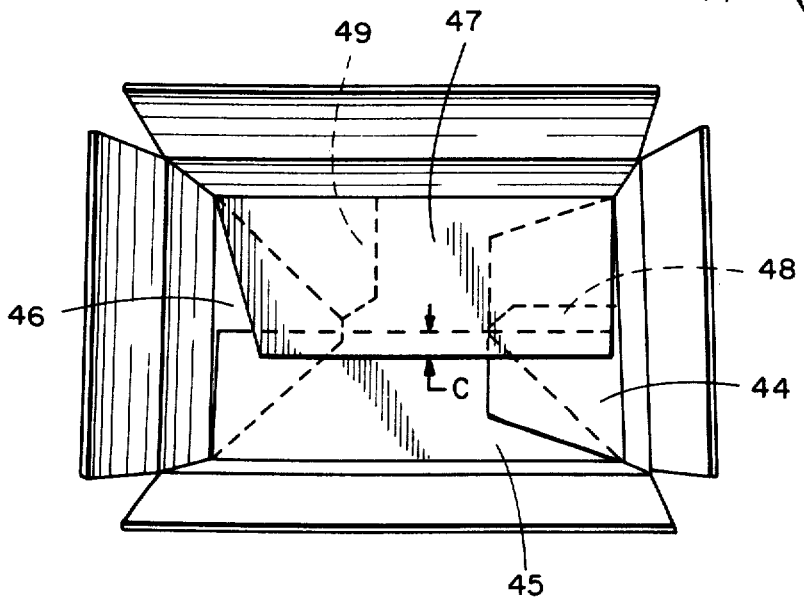
FIG. 6 is a plan view of the blank of FIG. 3.

Referring to FIGS. 4 through 6, the function of the pressure and relief flap portions of panels 44 and 46 can be seen. In this embodiment it will be recalled the carton container has an overlapping bottom panel 47. Thus, there is a possibility of bridging during assembly of the carton, i.e., the end of panel 47 and panel 45 striking each other as the bottom moves from the position illustrated in FIG. 5 to the full open position illustrated in FIGS. 4 and 6. In order to avoid bridging, the descent of panels 45 and 47 from their overlying position on the side panels to the deployed position illustrated in FIGS. 4 and 6 is closely controlled by the configuration of the pressure and relief portion of flaps 44 and 46. As best indicated in FIG. 5, as the carton assumes its rectangular form, the pressure flap portion A of panel 44 strikes or contacts panel 47. By contrast, the relief flap portion B does not contact panel 45 until much later in the assembly of the carton.

Thus, due to the dimensioning of the pressure and relief flap portions, the panels 45 and 47 can be made to deploy in a sequential manner. That is, panel 45 will reach its open position sooner than flap 47, thereby completely avoiding the possibility of bridging. As will be apparent, the necessary dimensions of the pressure and relief flap portions depend to a great extent upon the shape of the carton and to some extent upon the amount of overlap, i.e., dimension C in FIG. 3. The principal of this aspect of the invention, namely, the avoidance of bridging by using a pressure and relief flap to control the sequence of deployment of panels 45 and 47, has been clearly indicated. Having an understanding of this principal in mind, the necessary dimensions for various size cartons can be empirically determined. The greater the length of a carton and the smaller the overlap, the greater the possibility of bridging. A general rule developed empirically is that the ratio between the dimensions of the pressure flap and the relief flap should be between 1.5:1 and 2:1. However, the greater the length of the carton and the smaller the overlap, the higher the ratio should be. By empiric methods the following table has been developed for a variety of carton widths.

Table 1

| Width of Carton "D" (inches) | Pressure Flap "A" (inches) | Relief Flap "B" (inches) |
|---|---|---|
| 6 | 1½ | 1 |
| 7 | 1¾ | 1 |
| 8 | 1¾ | 1 |
| 9 | 2¼ | 1 |
| 10 | 2¼ | 1 |
| 11 | 2½ | 1¼ |
| 12 | 2½ | 1¼ |
| 13 | 2½ | 1¼ |
| 14 | 2½ | 1¼ |
| 15 | 2½ | 1¼ |
| 16 | 3 | 1½ |
| 17 | 3 | 1½ |
| 18 | 3¼ | 1½ |
| 19 | 3½ | 1½ |
| 20 | 4 | 2 |

It will be seen from Table 1 that for a 6 inch wide carton a 1.5:1 ratio between pressure and relief flap is utilized, whereas, for a 20 inch carton a 2 to 1 ratio is utilized.

The second important objective of the present invention is to overcome the tendency of an automatic bottom carton to collapse once assembled. To this end the pressure flap portion of bottom panel 44 serves a dual function. As it engages bottom flap 47 it restrains it from coming down towards the deployed position at the same time as panel 45. This restraint is manifested by the pressure flap portion A pressing against the bottom panel 47. This pressing tends to impede opening or closing of the carton. It is only after sufficient force has been applied to the ends of the carton to overcome the resistance of the pressure flap portion of panel 44 against panel 47 that the carton will open. As this force is overcome, panels 44 and 47 come into substantial parallelism thereby significantly relieving the pressure of the pressure flap on the panel 47.

As can be appreciated from FIG. 4, a stabilized construction is thus obtained since approximately the same force is necessary to collapse the carton as was necessary to erect it. Thus, the tendency of the carton to collapse is opposed by the resistance of the pressure flap against the bottom panel 47. Stated another way, the force exerted by the pressure flap on flap 47 must be overcome to erect the carton. This same force must be overcome for the carton to collapse. In the absence of manual assistance, the normal resiliency of a corrugated carton construction is insufficient to cause collapsing of the carton against the bias of the pressure flap. Since all of the panels are interconnected, the tendency of the bottom to collapse is inhibited.

Referring now to FIGS. 7 through 10, a second embodiment of the invention is disclosed. In this embodiment a carton construction is disclosed for an automatic bottom corrugated construction where no overlap is employed. That is, flaps 55 and 57 are of equal dimension and dimensioned so that they meet or just fail to meet in the deployed position. Thus, there is no possibility of bridging to occur since the two ends of flaps 55 and 57 cannot strike each other during opening. The carton construction shown in FIG. 7 has the usual side panels 50 through 53 from which depend the bottom panels 54 through 57. The glue flaps 58 and 59 are provided on the bottom panels 55 and 56, as indicated by the dashed portion.

Figure 7:
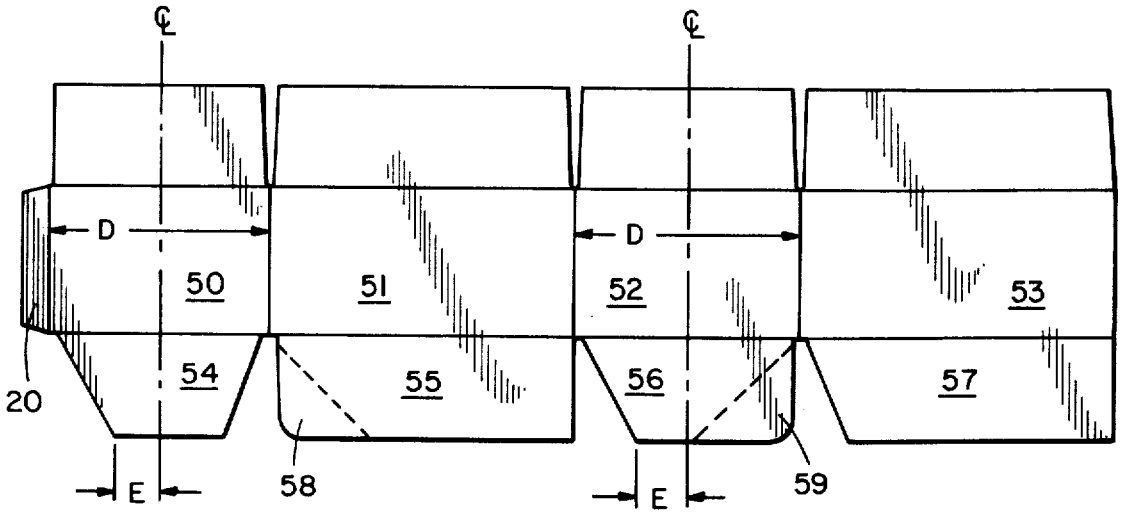
FIG. 7 is a corrugated carton blank according to a second embodiment of the invention employing two pressure flaps for a construction wherein there is no overlap.
Figure 8:
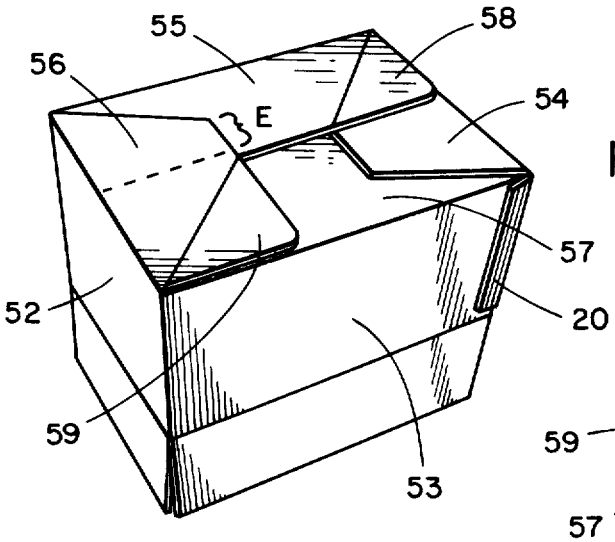
FIG. 8 is a bottom perspective view of the blank of FIG. 7.

In this construction, since there is no overlap there is no bridging problem. Accordingly, the only problem which must be solved is to prevent collapsing of the carton after opening. Since the relief flap is unnecessary, the embodiment of FIG. 7 is provided with two pressure flaps, thereby enhancing the resistance effect described previously.

Figure 9:
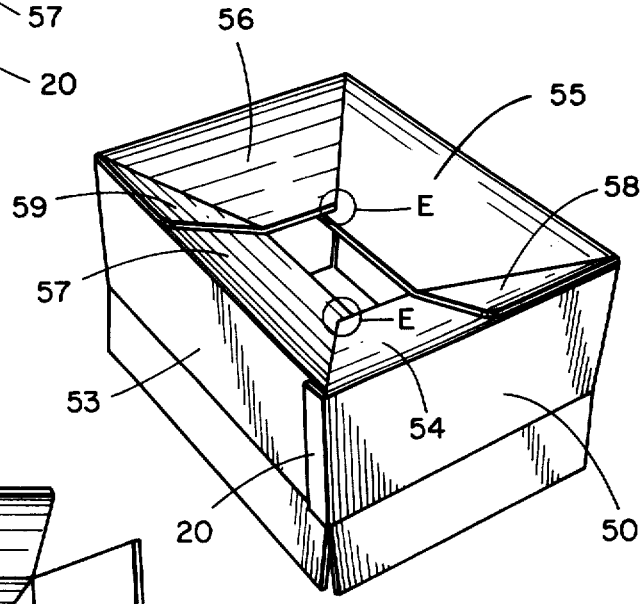
FIG. 9 is a view similar to FIG. 8 at a position intermediate the collapsed and opened positions illustrating the action of the pressure flap.
Figure 10:
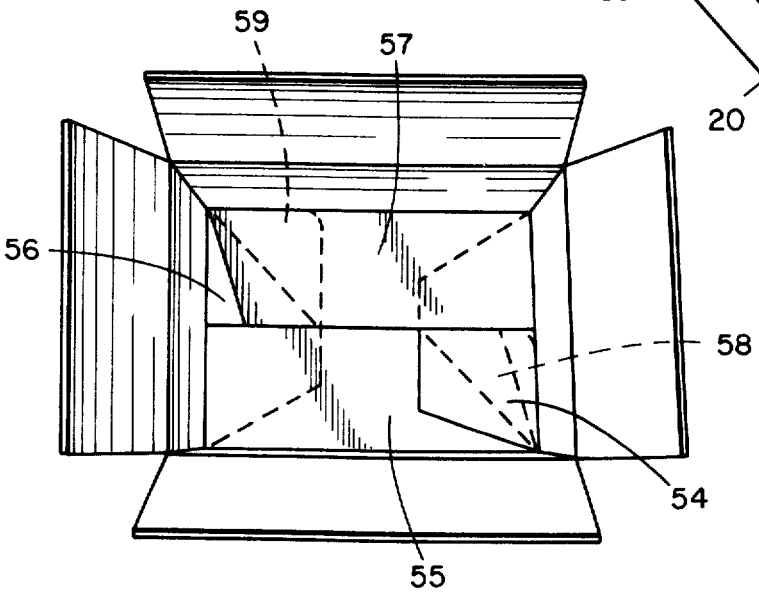
FIG. 10 is a plan view of the blank of FIG. 7.

Bottom panels 54 and 56 carry pressure flaps indicated by dimension E. Referring to FIG. 9, it will be seen that as the carton is pressed from its collapsed condition to its assembled condition, the pressure flaps E strike the bottom panels 55 and 57, respectively. In order to complete assembly of the carton, sufficient force must be exerted on the corners of the carton to overcome the resistance of both pressure flaps. Once this amount of pressure has been applied, the carton assumes the flap position indicated in FIGS. 8 and 10. In order for the carton to collapse, it would have to overcome the same pressure resistance of the pressure flaps E and, therefore, collapsing does not occur.

While the first embodiment solved two problems, namely, bridging and preventing collapse, the present embodiment is directed only to preventing collapse and does so with somewhat more certainty in view of the fact that two pressure flaps are provided. However, in both cases more than satisfactory results are obtained in maintaining the cartons open. With regard to this second embodiment, the dimension of the pressure flaps relative to dimension D (the width of panels 50 and 52) may fluctuate according to the effect desired by the box designer. However, as indicated in Table 2, certain dimensions for a range of cartons have been empirically determined.

Table 2

| Width of Carton "D" | Pressure Flaps "E" |
|---|---|
| 6" to 10" | 1½" to 1¾" |
| 10" to 14" | 2" to 2½" |
| 14" to 18" | 2½" to 3" |
| 18" to 20" | 3" to 4" |

An analysis of these figures reveals that the bottom panel outer edge dimension E is at least about 15 percent of the carton width D.

While we have shown and described embodiments of this invention in some detail, it will be understood that this description and the accompanying illustrations are offered merely by way of example, and that the invention is to be limited in scope only by the appended claims.

We claim:

1. In a corrugated container of the type having a bottom which automatically deploys to a locked configuration upon opening said container, said container being formed from a blank having four side panels and four bottom panels depending downwardly from said side panels, the improvement comprising:

at least one pressure flap located on one of said bottom panels for engaging and pressing against an adjacent bottom panel during opening and closing of said container to oppose said opening and closing whereby the container is opened by manual application of sufficient pressure to overcome the force of said pressure flap and will thereafter remain in the open position without tending to collapse due to the force of said pressure flap opposing such collapse, and wherein one of said bottom panels overlaps an opposite bottom panel, said pressure flap being located on one of the remaining two bottom panels, said blank further including:

a relief flap located on the other of said remaining panels, said relief flap being dimensioned, relative to said pressure flap, to permit said opposite bottom panel to deploy prior to said overlapping bottom panel, whereby the overlapping and the opposite bottom panels are prevented from bridging during movement to the open position.

2. The device according to claim 1 wherein the ratio of the width dimension of the pressure flap relative to the relief flap is in the range of 1.5 to 1 to 2 to 1.

3. An automatic set-up corrugated carton formed from a precut paper blank comprising:

a. four interconnected side panels folded into a generally rectangular configuration;

b. four bottom panels each interconnected with one of said side panels and forming a bottom for the carton extending in a plane perpendicular to the side panels;

c. glue flaps formed on two adjacent bottom panels adhesively securing each adjacent bottom panel to one of the other bottom panels to thereby form two pairs of bottom panels, said pairs having an over and under relationship wherein one outer end of one bottom panel in one pair extends over an outer end of one bottom panel in the other pair, and wherein the opposite outer end of the other bottom panel in said one pair extends under the opposite outer end of the other bottom panel in the other pair;

d. a scoreline extending between each glue flap and its associated bottom panel, a scoreline extending between each bottom panel and its respective side panel, and a scoreline extending between each adjacent side panel whereby the carton is adapted to be opened into a set-up condition and closed into a collapsed condition; and, e. at least one pressure flap located on one of said bottom panels in one pair for engaging and pressing against an adjacent bottom panel of the other pair throughout opening and closing of said container to oppose said opening and closing whereby the container is opened by manual application of sufficient pressure to overcome the force of said pressure flap and will thereafter remain in the open position without tending to collapse due to the force of said pressure flap opposing such collapse.

4. The device in accordance with claim 3 wherein said pressure flap defines a sharp corner for engaging and pressing against said adjacent bottom panel of said other pair, said engagement commencing adjacent the free edge of said adjacent bottom panel as opening of said carton is initiated, and said corner being continuously forced against said adjacent bottom panel of said other pair, while moving in a direction away from said free edge.

5. A device in accordance with claim 4 wherein said corner is positioned close to the scoreline defined between said adjacent bottom panel of said other pair and its associated side wall when said carton is in the open position.

6. A device in accordance with claim 5 wherein said pressure flap defines an outer edge extending to said corner, the length of said outer edge being at least about 15 percent of the width of said carton.

7. A device in accordance with claim 6 wherein a pressure flap is provided on one bottom panel of each pair for engaging and pressing against a respective adjacent bottom panel of the other pair.

8. A device in accordance with claim 6 wherein said adjacent bottom panel of the other pair overlaps the opposite bottom panel when the carton is in the open position, and including a relief flap defined by one bottom panel of said other pair, said relief flap being dimensioned, relative to said pressure flap, to permit said opposite bottom panel to deploy prior to said overlapping bottom panel, whereby the overlapping and the opposite bottom panels are prevented from bridging during movement to the open position.

9. A device in accordance with claim 8 wherein said relief flap includes an outer edge of shorter length than the outer edge of the pressure flap, each of said outer edges extending beyond the center lines of the respective bottom panels defining the pressure and relief flaps.

10. A device in accordance with claim 1 wherein said pressure flap defines an outer edge extending to said corner, the length of said outer edge being at least about fifteen percent of the width of said carton, and wherein said relief flap includes an outer edge of shorter length than the outer edge of the pressure flap, each of said outer edges extending beyond the center lines of the respective bottom panels defining the pressure and relief flaps.

* * * * *